US008276642B2

(12) United States Patent
Berman et al.

(10) Patent No.: US 8,276,642 B2
(45) **Date of Patent: *Oct. 2, 2012**

(54) TROUGH SHADE SYSTEM AND METHOD

(75) Inventors: Joel Berman, Hewlett, NY (US); Xi Ming Li, New York, NY (US); Eugene Miroscnichenko, Oceanside, NY (US)

(73) Assignee: MechoShade Systems, Inc., Long Island City, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/205,863

(22) Filed: Aug. 9, 2011

(65) Prior Publication Data

US 2011/0290432 A1 Dec. 1, 2011

Related U.S. Application Data

(63) Continuation of application No. 12/266,632, filed on Nov. 7, 2008, now Pat. No. 8,016,016.

(51) Int. Cl.
*E06B 9/174* (2006.01)

(52) U.S. Cl. ..... 160/242; 160/323.1; 160/900

(58) Field of Classification Search ..... 160/242, 160/310, 133, 323.1, 903, 246–261, 405; 242/591, 592, 399, 399.1, 399.2
See application file for complete search history.

(56) References Cited

U.S. PATENT DOCUMENTS

| | | | | | |
|---|---|---|---|---|---|
| 910,657 | A | * | 1/1909 | Fleishaker | 248/270 |
| 1,054,131 | A | * | 2/1913 | Mealy | 248/266 |
| 1,559,902 | A | * | 11/1925 | Miller | 248/270 |
| 1,825,198 | A | | 9/1931 | Bruno | |
| 3,730,469 | A | * | 5/1973 | Shields | 248/265 |
| 3,882,921 | A | | 5/1975 | Sandall | |
| 3,900,063 | A | | 8/1975 | Roller | |
| 4,140,294 | A | * | 2/1979 | Zwarts | 248/265 |
| 4,260,125 | A | * | 4/1981 | Levine | 248/675 |
| 4,347,886 | A | | 9/1982 | Von Knorring | |
| 4,947,937 | A | | 8/1990 | Searer et al. | |
| 4,976,302 | A | | 12/1990 | Taylor | |
| 5,119,867 | A | | 6/1992 | Lukos | |
| 5,121,782 | A | | 6/1992 | Renkhoff et al. | |
| 5,224,307 | A | | 7/1993 | Lukos | |

(Continued)

FOREIGN PATENT DOCUMENTS

DE 4234359 4/1993

(Continued)

OTHER PUBLICATIONS

USPTO; Restriction Requirement dated Oct. 15, 2010 in U.S. Appl. No. 12/266,632.

(Continued)

*Primary Examiner* — David Purol
(74) *Attorney, Agent, or Firm* — Snell & Wilmer L.L.P.

(57) ABSTRACT

A trough shade system and method of use provide improved support for a roller tube and shade material. The roller tube and wound shade material are located within a support cradle to minimize unwanted deflection by the roller tube and associated wrinkling and deformation of the shade material. Various mechanisms allow the roller tube a limited range of movement within the support cradle. The system is suitable for shading larger areas than other shading systems which rely on roller tubes with fixed supports at the ends.

20 Claims, 4 Drawing Sheets

U.S. PATENT DOCUMENTS

| | | | |
|---|---|---|---|
| 5,273,095 | A | 12/1993 | Lukos |
| 5,492,162 | A | 2/1996 | Lohausen |
| 5,819,831 | A | 10/1998 | Schanz |
| 6,024,152 | A | 2/2000 | Rosenich |
| 6,209,839 | B1 | 4/2001 | O'Malley |
| 6,457,508 | B1 | 10/2002 | Tomita |
| 6,478,070 | B2 | 11/2002 | Poppema |
| 6,557,303 | B2 | 5/2003 | Finke et al. |
| 7,111,662 | B2 | 9/2006 | Lukos |
| 7,134,473 | B2 | 11/2006 | Lukos |
| 7,275,581 | B2 | 10/2007 | Coenraets |
| 2006/0060306 | A1 | 3/2006 | Lukos |
| 2006/0060313 | A1 | 3/2006 | Lukos |
| 2006/0070708 | A1 | 4/2006 | Lukos |
| 2006/0207731 | A1 | 9/2006 | Lukos |
| 2007/0181270 | A1 | 8/2007 | Spiess |

FOREIGN PATENT DOCUMENTS

| | | |
|---|---|---|
| DE | EP0792978 | 1/1997 |
| DE | EP1030003 | 2/2000 |

OTHER PUBLICATIONS

USPTO; Office Action dated Jan. 26, 2011 in U.S. Appl. No. 12/266,632.

USPTO; Notice of Allowance dated Jun. 24, 2011 in U.S. Appl. No. 12/266,632.

* cited by examiner

TROUGH SHADE SYSTEM AND METHOD

CROSS-REFERENCE TO RELATED APPLICATIONS

This application is a continuation of U.S. Ser. No. 12/266,632 filed on Nov. 7, 2008, now U.S. Patent Application Publication No. 2010/0116443 entitled "TROUGH SHADE SYSTEM AND METHOD". The entire contents of the foregoing application are hereby incorporated by reference.

FIELD OF INVENTION

This invention generally relates to shade systems, and more specifically, to trough-style supports in conjunction with shade systems.

BACKGROUND OF THE INVENTION

A variety of shade systems currently exist to deploy and retrieve a shade fabric over an area where shading is desired. Such systems often comprise a shade fabric wrapped around a roller tube, with supports located at the ends of the roller tube. However, the weight of the wound-up shade fabric may cause the support tube to bow, particularly in the middle of the tube. To avoid this undesirable condition, larger diameter, thicker, and/or stronger support tubes may be provided, or the amount of shade fabric may be reduced. These solutions restrict the amount of area that may be shaded, add further costs and increase the weight of the shading system. Therefore, a strong need exists for a shade system capable of deploying a larger area of shade fabric, wide, high, and monumental shades, while minimizing deflection of the shade tube and corresponding wrinkling of the shade fabric.

SUMMARY OF THE INVENTION

A trough shade system and method of use is disclosed. In one embodiment, a shade system comprises a support cradle configured to support a roller tube having a roller axis, and a floating plate configured with: a first channel configured to allow the roller axis of the roller tube to move a limited range along only a first axis of movement with respect to the support cradle, and a second channel configured to allow the roller axis of the roller tube to move a limited range along only a second axis of movement with respect to the support cradle.

In another embodiment, a shade system comprises a roller tube having a roller axis, a support cradle configured to support the roller tube, and a floating plate configured to allow the roller tube to move along a first axis of movement and along a second axis of movement. Movement of the roller axis of the roller tube along the first axis of movement is independent of movement of the roller axis of the roller tube along the second axis of movement.

In another embodiment, a method comprises moving, with respect to a support cradle in a shade system, the roller axis of a roller tube. The moving is guided by a floating plate configured with: a first channel configured to allow the roller axis of the roller tube to move a limited range along only a first axis of movement with respect to the support cradle, and a second channel configured to allow the roller axis of the roller tube to move a limited range along only a second axis of movement with respect to the support cradle.

BRIEF DESCRIPTION OF THE DRAWINGS

The accompanying drawings, wherein like numerals depict like elements, illustrate exemplary embodiments of the present invention, and together with the description, serve to explain the principles of the invention. In the drawings.

DETAILED DESCRIPTION

The detailed description of exemplary embodiments of the invention herein shows the exemplary embodiment by way of illustration, diagrams, charts and various processing steps including the best mode. While these exemplary embodiments are described in sufficient detail to enable those skilled in the art to practice the invention, it should be understood that other embodiments may be realized and that logical and mechanical changes may be made without departing from the spirit and scope of the invention. Thus, the detailed description herein is presented for purposes of illustration only and not of limitation. For example, the steps recited in any of the method or process descriptions may be executed in any order and are not limited to the order presented.

Moreover, for the sake of brevity, certain sub-components of individual components and other aspects of the system may not be described in detail herein. Furthermore, the connecting lines shown in the various figures contained herein are intended to represent exemplary functional relationships and/or physical couplings between the various elements. It should be noted that many alternative or additional functional relationships, wireless connections or physical couplings may be present in a practical system. Such functional blocks may be realized by any number of components configured to perform specified functions.

Figure 1:
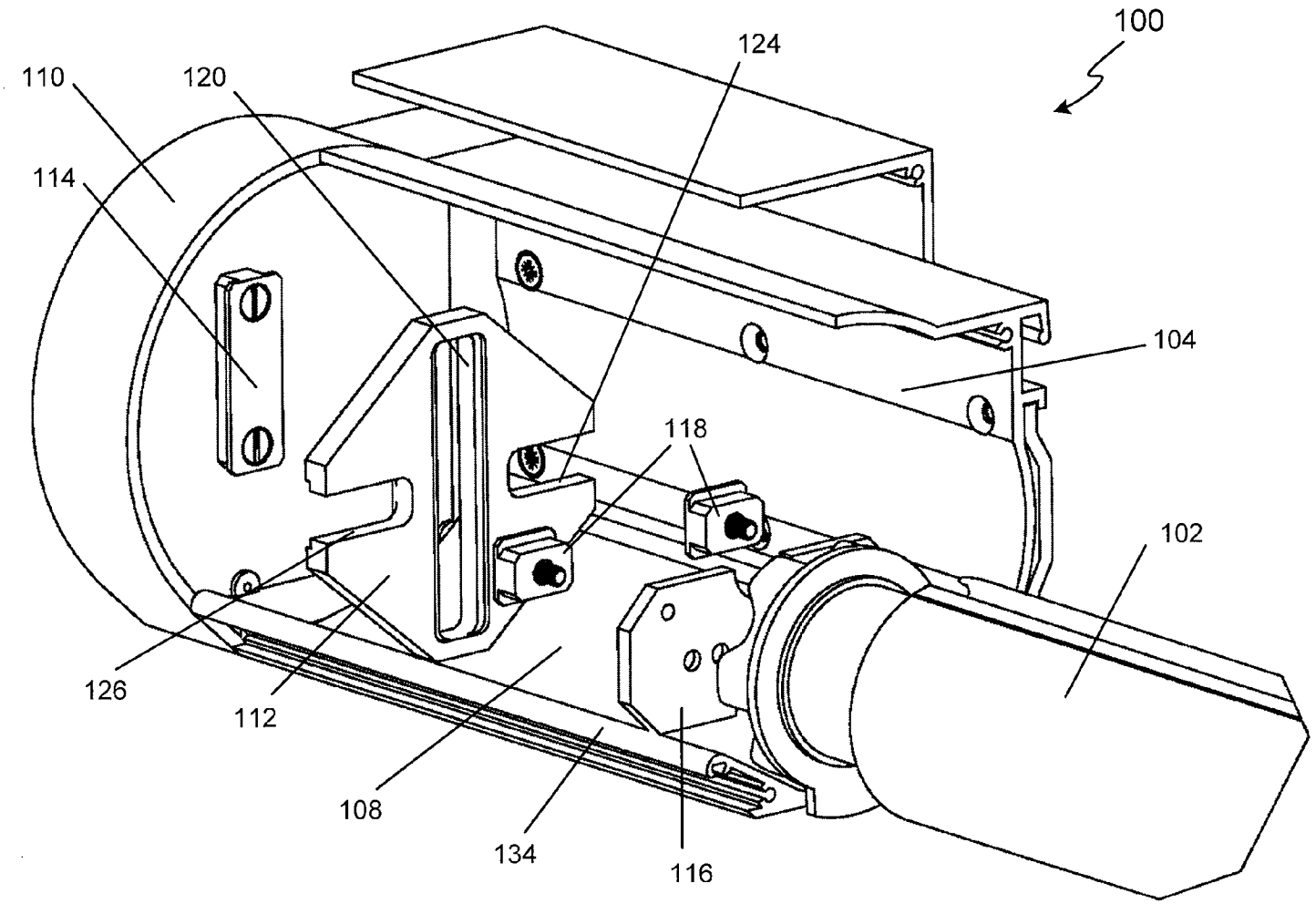
FIG. 1 illustrates an exploded view of a trough shade system in accordance with an exemplary embodiment of the present invention.

Trough shade system 100 is configured to deploy and retrieve a shade fabric wrapped around roller tube 102, while enabling movement of the roller tube 102 within a support cradle 108 such that the shade fabric is deployed and retrieved in a sufficiently constant plane. With reference to FIG. 1, and in accordance with an exemplary embodiment, trough shade system 100 comprises a roller tube 102, housing 104, support cradle 108, end cap 110, floating plate 112, motor plate 116, rollers 114 and 118, and motor 130 (not shown).

Continuing with reference to FIG. 1, and in accordance with an exemplary embodiment, roller tube 102 comprises a structure configured to receive and support shade material in a winding manner. In one embodiment, roller tube 102 comprises a metal alloy, a composite structure, a plastic structure, a carbon fiber structure, or other suitable material configured to receive and support shade material in a winding manner. Roller tube 102 may include grooves, flanges, trenches, or other portions configured to facilitate attachment of shade material to roller tube 102. Moreover, roller tube 102 may be configured in any suitable manner for receiving and supporting shade material.

In one embodiment, roller tube 102 is coupled to motor 130. Through operation of motor 130, a portion of shade material is unrolled from roller tube 102 and/or rolled around roller tube 102. In other exemplary embodiments, roller tube 102 may be rolled using manual force via, for example, a chain. Roller tube 102 may be operated in any appropriate manner and via any appropriate mechanism to cause shade material to unroll from and/or roll onto roller tube 102.

Any appropriate shade material, such as fabrics comprising polyester, cotton, nylon, Teflon, high density polyethelyene (HDPE), polyvinyl chloride (PVC), thermoplastic olefin (TPO), fiberglass, room darkening and/or blackout fabrics with a laminated or black-out coating, and the like, and/or any combination of the above, may be used with roller tube 102. Further, shade material may be any type of material used for facilitating control of solar glare, daylighting, brightness, contrasting brightness, luminance ratios, room darkening, blackout, solar heat gain or loss, UV exposure, uniformity of design and/or for providing a better interior environment for the occupants of a structure supporting increased productivity, and the like.

Figure 2:
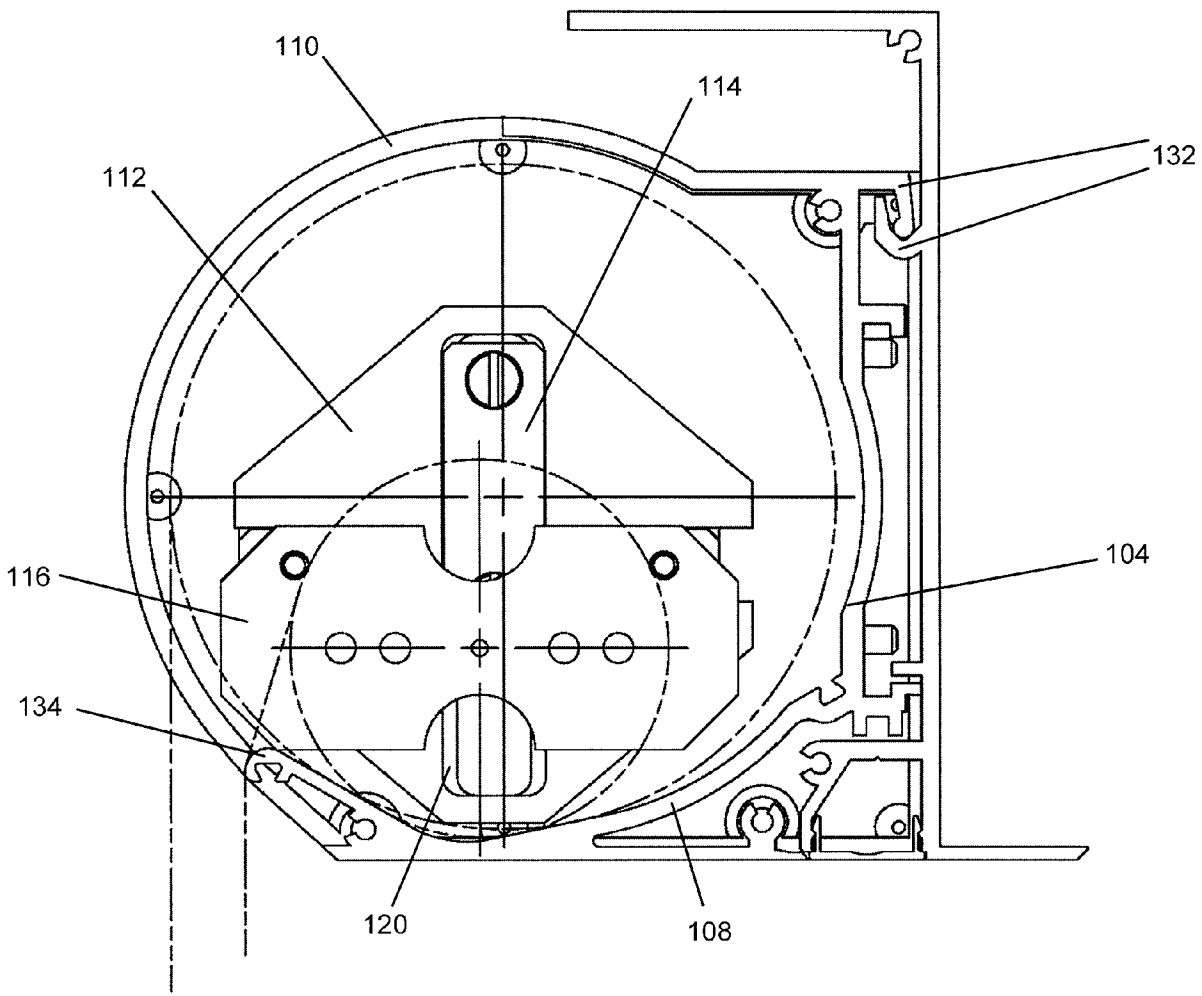
FIG. 2 illustrates a cut-away view of a trough shade system showing the roller tube having various portions of the shade material wound around the roller tube and the roller tube resting within the support cradle, in accordance with an exemplary embodiment of the present invention.

With reference to FIGS. 1 and 2 and in accordance with an exemplary embodiment, housing 104 comprises a structure configured to partially or fully encase roller tube 102 and/or other components. Housing 104 may function as the main body of trough shade system 100. Housing 104 may comprise aluminum, steel, copper, magnesium, titanium, or other suitable durable metal, and/or various alloys of or variations on the same, such as stainless steel, A36 steel, galvanized steel, duralumin, silumin, 6061 aluminum, and the like, or any combination thereof. Housing 104 may also comprise a composite structure, a plastic structure, a carbon fiber structure, or other suitable material. Further, housing 104 is configured for mounting on a building or other surface. Accordingly, housing 104 may be coupled to a building, such as by mounting hardware, e.g., screws and/or other mechanical fasteners. Moreover, housing 104 may be mounted to any appropriate surface via any suitable technique to secure housing 104 in place. Housing 104 is coupled to end cap 110 and to support cradle 108. Housing 104 may also be coupled to various other components, including fascia 106 and the like.

Housing 104 may comprise multiple portions. For example, a first portion of housing 104 may be coupled to a building. A second portion of housing 104 may be coupled to the first portion via one or more support clips 132. Moreover, portions of housing 104 may be coupled together in any appropriate manner configured to secure the portions of housing 104 in place.

Fascia 106 (not shown) comprises a structure configured to partially or fully hide a subset or all of the components of system 100. In one embodiment, fascia 106 is configured to couple with housing 104. Fascia 106 may partially or fully comprise aluminum, steel, copper, magnesium, titanium, or other suitable durable metal, and/or various alloys of or variations on the same, such as stainless steel, A36 steel, galvanized steel, duralumin, silumin, 6061 aluminum, and the like, or any combination thereof. Fascia 106 may also comprise a composite structure, a plastic structure, a carbon fiber structure, or other suitable material. Further, fascia 106 may protect the inner portions of trough shade system 100 from exposure to dirt, debris, and other foreign matter which may impair the operation of trough shade system 100. Moreover, fascia 106 may comprise a composite structure, a plastic structure, a carbon fiber structure, or other suitable material. In one embodiment, fascia 106 is coupled to housing 104 via a snap fit. In other embodiments, fascia 106 may be coupled to housing 104 via adhesives, mechanical fasteners, slip fits, and the like.

Returning to FIGS. 1 and 2, in one embodiment, support cradle 108 comprises a structure configured to support a roller tube, such as roller tube 102, having shade material wound thereon. Support cradle 108 may partially or fully comprise aluminum, steel, copper, magnesium, titanium, or other suitable durable metal, and/or various alloys of or variations on the same, such as stainless steel, A36 steel, galvanized steel, duralumin, silumin, 6061 aluminum, and the like, or any combination thereof. Support cradle 108 further comprises a low-friction coating in order to facilitate easier deployment (unrolling) and retrieval (rolling) of shade material from roller tube 102. In other exemplary embodiments, support cradle 108 partially or fully comprises a low-friction material, such as high-density polyethelyne (HDPE), ultra-high molecular weight polyethelyne (UHMW-PE), polyoxymethelyne (e.g., Delrin®), polytetrafluoroethylene (e.g., Teflon®), polyethylene terephthalate, and the like, or any combination thereof. Further, support cradle 108 may comprise any base material having desirable strength and/or weight characteristics. The base material may then be partially or fully coated with a low-friction material to achieve desired properties for support cradle 108. Support cradle 108 may be coupled to housing 104. Moreover, support cradle 108 may be continuously supported by housing 104. In this manner, shade material wound on a roller tube may be supported across the length of the shade for improved safety.

In one embodiment, with reference to FIGS. 1 and 2, support cradle 108 is configured to partially or fully support shade material wound around roller tube 102. For example, support cradle 108 may be symmetrical, asymmetrical, curved, arc-shaped, crescent-shaped, parabolic, hyperbolic, and the like. Support cradle 108 may also be comprised of multiple segments, such as segments having a flat face. Individual segments with a flat face of various inclinations may be coupled together to form support cradle 108. As used herein, the side of support cradle 108 nearer to the area where shade material is deployed from trough shade system 100 is referred to as the "feed side". The side of support cradle 108 opposite the feed side is referred to as the "rear side".

As best shown in FIGS. 1 and 2, in various embodiments, support cradle 108 is partially or fully configured with bull nose 134 at the feed side. Bull nose 134 may partially or fully guide shade material during unrolling. Further, bull nose 134 may partially or fully prevent roller tube 102 and wound-up shade fabric from moving out of support cradle 108 during operation of trough shade system 100, and may assist in keeping roller tube 102 and wound-up shade fabric centered in support cradle 108. In an exemplary embodiment, bull nose 134 at the feed side of support cradle 108 extends a sufficient distance from the center of shade tube 102 to cause the shade fabric to be deployed and retrieved in a sufficiently constant plane. Moreover, bull nose 134 at the feed side of support cradle 108 may comprise a roller bearing, a solid shape, or any other component or components configured to prevent roller tube 102 and wound-up shade material from rolling out of support cradle 108 and/or allow or the smooth movement of fabric during operation of trough shade system 100.

In another exemplary embodiment, support cradle 108 is configured with a stop or tube dam at the feed side. The tube dam may comprise a roller bearing which partially or fully extends the length of support cradle 108. Alternatively, the feed side tube dam may comprise a solid shape or any other component or components configured to prevent roller tube 102 and wound-up shade material from rolling out of support cradle 108 and/or allow or the smooth movement of fabric during operation of trough shade system 100. The feed side tube dam may guide shade material during unrolling. Further, the feed side tube dam may partially or fully prevent roller tube 102 and wound-up shade fabric from moving out of support cradle 108 during operation of trough shade system 100, and may assist in keeping roller tube 102 and wound-up shade fabric centered in support cradle 108.

In one embodiment, support cradle 108 is configured with a stop tube dam at the rear side. The rear side tube dam may comprise a roller bearing which partially or fully extends the length of support cradle 108. In another embodiment, the rear side tube dam may comprise a continuous bearing, a moulded shape, and the like. Further, the rear side tube dam may partially or fully prevent roller tube 102 and wound-up shade fabric from moving out of support cradle 108 during operation of trough shade system 100, and may assist in partially or fully keeping roller tube 102 and wound-up shade fabric centered in support cradle 108.

Returning to FIGS. 1 and 2 and in one embodiment, end cap 110 comprises a structure configured to partially or fully couple with housing 104. End cap 110 may partially or fully comprise aluminum, steel, copper, magnesium, titanium, or other suitable durable metal, and/or various alloys of or variations on the same, such as stainless steel, A36 steel, galvanized steel, duralumin, silumin, 6061 aluminum, and the like, or any combination thereof. End cap 110 may also partially or fully comprise a composite structure, a plastic structure, a carbon fiber structure, or other suitable material. In one embodiment, end cap 110 is configured to couple with housing 104, and with floating plate 112 via roller 114. Further, fascia 106 may also be coupled to end cap 110. End cap 110 may be configured for partially or fully mounting to a building or other surface, such as by mounting hardware, e.g., screws and/or other mechanical fasteners. Moreover, end cap 110 may be mounted to any appropriate surface via any suitable technique to secure end cap 110 in place.

Continuing to reference FIGS. 1 and 2 and in one embodiment, floating plate 112 comprises a structure configured to enable movement of roller tube 102. Floating plate 112 is configured to partially or fully couple with rollers 114 and 118. Floating plate 112 may partially or fully comprise aluminum, steel, copper, magnesium, titanium, or other suitable durable metal, and/or various alloys of or variations on the same, such as stainless steel, A36 steel, galvanized steel, duralumin, silumin, 6061 aluminum, and the like, or any combination thereof. Floating plate 112 may also partially or fully comprise a composite structure, a plastic structure, a carbon fiber structure, or other suitable material. Floating plate 112 is coupled to end cap 110 via roller 114. Further, floating plate 112 is coupled to motor plate 116 via rollers 118. Floating plate 112 may also be coupled to motor plate 116 via other low friction assemblies.

In accordance with one embodiment, floating plate 112 includes one or more channels, grooves, or any other configuration or device which allows roller tube 102 to move. In one embodiment, floating plate 112 includes four channels, including two vertical channels and two horizontal channels all separated by a block. In another embodiment, floating plate 112 includes three channels, including one vertical channel 120 separating two horizontal channels 124, 126. Moreover, floating plate 112 may include any suitable number of channels, grooves, or other configurations or devices which allow roller tube 102 to move.

Floating plate 112 is configured to allow roller tube 102 to move in a vertical direction responsive to guidance from roller 114. Further, floating plate 112 is configured to allow roller tube 102 to move in a horizontal direction responsive to guidance from rollers 118. In this manner, the ends of roller tube 102 are confined to a limited range of movement with respect to support cradle 108. However, roller tube 102 may move within support cradle 108, such as in response to forces generated during winding or unwinding shade material. The ends of roller tube 102 may move in a vertical and/or horizontal direction, thereby reducing bowing, bending, and other deformation of roller tube 102.

In another exemplary embodiment, roller tube 102 may be allowed to move in a horizontal and/or vertical direction with respect to support cradle 108 through use of an inclined guide rail coupled to the ends of roller tube 102. In one embodiment, roller tube 102 may be allowed to move in a horizontal and/or vertical direction with respect to support cradle 108 through use of a pivoting arm assembly.

With further reference to FIGS. 1 and 2 and in one embodiment, end cap 110 includes at least one roller 114 which is partially or fully received into floating plate 112. Roller 114 may comprise bearings, low friction guides, enclosed or encapsulated bearings, and the like. Roller 114 is configured to allow roller tube 102 to have a limited range of vertical movement. Roller 114 is received into vertical channel 120 of floating plate 112 such that roller 114 allows roller tube 102 to translate vertically within a limited range. In one embodiment, the limited range is defined by the length of vertical channel 120 within floating plate 112. Roller 114 may thus roll within vertical channel 120, but the vertical motion is stopped when roller 114 hits the top or bottom of vertical channel 120. The vertical movement of roller tube 102 causes motor plate 116 to impact the top or bottom portion of the horizontal channels within floating plate 112, thereby causing vertical movement of floating plate 112 around roller 114.

In another embodiment, the limited range is defined by the length of two collinear vertical channels within floating plate 112. The two vertical channels within floating plate 112 are divided by a block such that two vertical channels are formed within floating plate 112, thereby allowing each roller 114 to roll within a respective channel, but the vertical motion is stopped when a roller 114 hits the block between the vertical channels.

Continuing with reference to FIGS. 1 and 2 and in one embodiment, motor plate 116 comprises a structure configured to couple with floating plate 112 via rollers 118. Motor plate 116 may be configured to couple with motor 130 (not shown). Motor plate 116 may partially or fully comprise aluminum, steel, copper, magnesium, titanium, or other suitable durable metal, and/or various alloys of or variations on the same, such as stainless steel, A36 steel, galvanized steel, duralumin, silumin, 6061 aluminum, and the like, or any combination thereof. Motor plate 116 may also partially or fully comprise a composite structure, a plastic structure, a carbon fiber structure, or other suitable material. Motor plate 116 may be partially or fully received into floating plate 112 via one or more rollers such as rollers 118.

Rollers 118 are partially or fully received into the horizontal channels 124, 126 of floating plate 112 such that rollers 118 enable roller tube 102 to translate horizontally within a limited range. In one embodiment, the limited range is defined by the length of the horizontal channels 124, 126 within floating plate 112. In one embodiment, the horizontal channels 124, 126 within floating plate 112 are divided by a block such that two horizontal channels 124, 126 are formed within floating plate 112, thereby allowing each roller 118 to roll within a respective channel, but the horizontal motion is stopped when a roller hits the block between the channels. In another embodiment, the horizontal channels 124, 126 within floating plate 112 are divided by vertical channel 120 such that two horizontal channels 124, 126 are formed within floating plate 112, thereby allowing each roller 118 to roll within a respective channel, but the horizontal motion is stopped when a roller 188 reaches the end of a respective channel. Rollers 118 may comprise bearings, low friction guides, enclosed or encapsulated bearings, and the like. Rollers 118 are configured to allow roller tube 102 to have a limited range of horizontal movement. Further, motor plate 116 is configured to allow roller tube 102 to move in a horizontal direction responsive to guidance from rollers 118. In this manner, the ends of roller tube 102 are confined to a limited range of horizontal movement with respect to support cradle 108. However, roller tube 102 may move within support cradle 108, such as in response to forces generated during winding or unwinding of the shade material.

Motor 130 (not shown) may be coupled to motor plate 116 and to roller tube 102. Motor 130 may comprise any suitable device configured to provide rotational force to roller tube 102, such as, for example, a brushless direct current (DC) motor, a brushed DC motor, a coreless DC motor, a linear DC motor, and the like. Motor 130 may also comprise an alternating current (AC) motor, an induction motor, a cage rotor motor, a slip ring motor, a stepper motor, and the like. Moreover, any motor or similar device presently known or adopted in the future to drive shade tube 102 within trough shade system 100 falls within the scope of the present invention. In other exemplary embodiments, motor 130 may be replaced with another suitable power generation mechanism capable of moving roller tube 102. In various exemplary embodiments, motor 130 comprises a tubular motor inserted into roller tube 102 and coupled to motor plate 116.

In one exemplary embodiment, motor 130 may be configured as any type of stepping motor capable of moving roller tube 102 at select, random, predetermined, increasing, decreasing, algorithmic or any other increments. For example, motor 130 may be configured to move roller tube 102 in 1/16-inch or 1/8-inch increments. Further, motor 130 may also be configured to have each step and/or increment last a certain amount of time. The time of the increments may be any range of time, for example, less than one second, one or more seconds, and/or multiple minutes. In one embodiment, each 1/8-inch increment of motor 130 may last five seconds. Motor 130 may be configured to move roller tube 102 at a rate which results in virtually imperceptible movement of the shade fabric. For example, motor 130 may be configured to continually iterate finite increments, thus establishing thousands of intermediate stopping positions across a shaded area. The increments may be consistent in span and time or may vary in span and/or time across the day and from day to day in order to optimize the comfort requirements of the space and further minimize abrupt window covering positioning transitions, such as those which may draw unnecessary attention from the occupants of a building.

Motor 130 (not shown) may be activated to cause rotation of roller tube 102 in order to unroll a portion of shade fabric. Shade fabric may be deployed from the feed side of trough shade system 100. A portion of the shade fabric may move across the feed side edge of support cradle 108, such as bull nose 134. In this manner, shade fabric may be guided as it exits the trough shade system 100. Moreover, shade fabric may be deployed without moving across the feed side edge of support cradle 108. In various exemplary embodiments, shade fabric is deployed from trough shade system 100 in a sufficiently constant and consistent plane with respect to the shaded surface. Moreover, shade fabric may be deployed from trough shade system 100 in a plane controlled by the location of the bull nose in support cradle 108.

In other exemplary embodiments, the distance between the shade fabric and the shaded surface may vary, e.g., as a result of variation in the amount of shade fabric remaining in a wound condition on roller tube 102, as a result of the location of bull nose 134, and the like. Friction on the shade fabric may thus be reduced, as the shade fabric may contact bull nose 134 during only a portion of the shade deployment and/or retrieval.

In an exemplary embodiment, motor 130 may be activated to cause rotation of roller tube 102 in order to roll up a portion of shade fabric. Shade fabric may be retrieved at the feed side of trough shade system 100. A portion of the shade fabric may move across the feed side edge of support cradle 108, such as bull nose 134. In this manner, shade fabric may be guided as it returns into trough shade system 100 and is wound on roller tube 102. Moreover, shade fabric may be retrieved without moving across the feed side edge of support cradle 108. In an exemplary embodiment, shade fabric is retrieved into trough shade system 100 in a sufficiently constant plane with respect to a shaded surface. In other exemplary embodiments, the distance between the shade fabric and the shaded surface may vary, e.g., as a result of variation in the amount of shade fabric collected in a wound condition on roller tube 102.

In accordance with various exemplary embodiments, trough shade system 100 comprises a double shade. For example, two shades may be provided in a back to back arrangement, an over/under arrangement, and the like. The first shade may be a room darkening/blackout shade. The second shade may be a sunscreen shade. Moreover, the first and second shade may be any appropriate shade material. The shades may be deployed, retrieved, and/or operated individually and/or together.

A shade may comprise side channels to minimize edge-of-shade light leaks (such as those occurring due to distance between the edge of a fabric shade and the end of support cradle 108). Moreover, smooth deployment of a shade fabric without changing the location of the shade fabric in relation to side channels or windows may allow long, high shades to be inserted into side channels. Additionally, use of a floating bearing design may enable reduction of the gap between the end of a shade and the end of a support trough.

A sunscreen shade may comprise a solar protection shade fabric. The solar protection shade fabric may be installed as a single shade. The solar protection shade fabric may also be installed as a series of individual shades, for example shades adjacent to each other and having a space between shades of between approximately 1/4 inch to 3/4 inch, or a wider space as appropriate in order to compliment or mimic the module of one or more windows intended to be covered. Individual shades coupled to a single roller tube 102 will operate together as a single unit.

Trough shade system 100 may also comprise a triple shade, a four-shade system, and the like. Any suitable number of shades may be provided, as desired.

In accordance with various exemplary embodiments, trough shade system 100 may be provided and installed in at least two portions. For example, a housing/support portion may be installed first. At least one trough portion may then be attached to and supported by the housing/support portion. Internal leveling devices may be provided in order to level and adjust the trough to assist with uniform operation and tracking of the shade bands. Moreover, internal attachments, such as Z-type clips, may facilitate installation and/or removal of one or more trough portions from the support/housing portion.

Figure 3A:
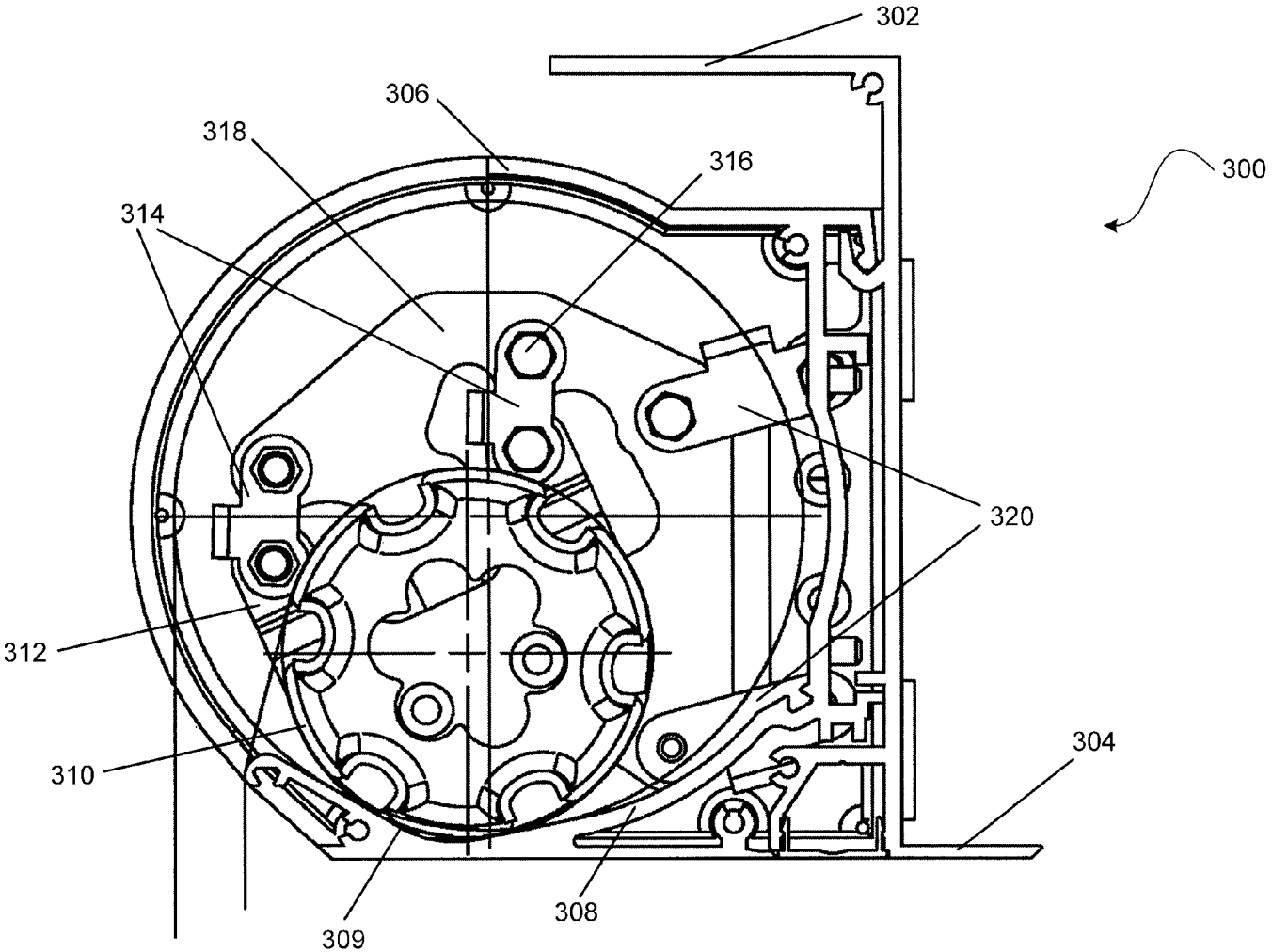
FIG. 3A illustrates a cut-away view of a trough shade system comprising various control linkages and support plates, in accordance with an exemplary embodiment of the present invention.
Figure 3B:
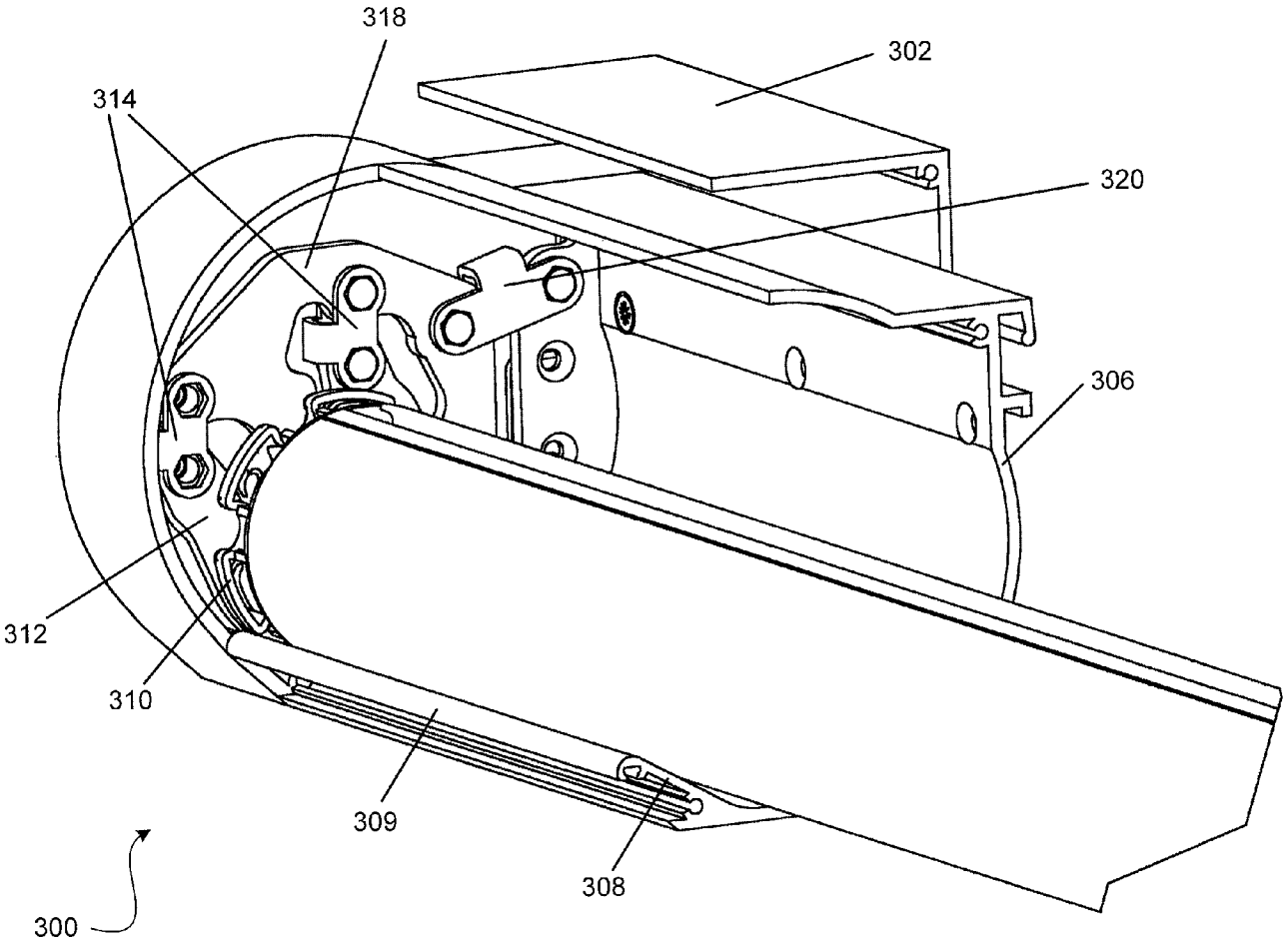
FIG. 3B illustrates an isometric view of a trough shade system comprising various control linkages and support plates, in accordance with an exemplary embodiment of the present invention.

With reference now to FIGS. 3A and 3B, and in accordance with an exemplary embodiment, trough shade system 300 comprises mounting clip 302, housing 306, support cradle 308 comprising anti-friction coating 309, roller tube end portion 310, first mounting plate 312, horizontal control linkages 314, bearings 316, second mounting plate 318, vertical control linkages 320, and motor 322 (not shown).

Mounting clip 302 may be mounted to any appropriate surface. Mounting clip 302 is coupled to housing 306. Mounting clip 302 may also comprise ceiling tile support hanger 304.

Housing 306 is coupled to support cradle 308. Housing 306 may provide support to support cradle 308 throughout the length of support cradle 308. Shade fabric wound around a roller tube coupled to roller tube end portion 310 may be supported via support cradle 308. Support cradle 308 may comprise an anti-friction coating in order to reduce friction between support cradle 308 and shade fabric. Support cradle 308 may further comprise various components on the feed side and/or rear side, such as a bull nose, a roller bearing, a tube dam, and the like.

Motor 322 (not shown in the figures) is coupled to roller tube end portion 310. In this manner, force provided by motor 322 may be translated into movement of at least one shade fabric coupled to a roller tube.

Continuing to reference FIGS. 3A and 3B, roller tube end portion 310 is in turn coupled to a first mounting plate 312. First mounting plate 312 is coupled to at least two horizontal control linkages 314 via a series of bearings 316. Horizontal control linkages 314 may be configured to allow a roller tube to move in a substantially horizontal direction.

Horizontal control linkages 314 are coupled to second mounting plate 318. Second mounting plate 318 is in turn coupled to housing 306 by way of at least two vertical control linkages 320. Vertical control linkages 320 may be configured to allow a roller tube to move in a substantially vertical direction. Reactive torque loading from operation of motor 322 may thus be distributed via horizontal control linkages 314 and vertical control linkages 320.

Benefits, other advantages, and solutions to problems have been described herein with regard to specific embodiments. However, the benefits, advantages, solutions to problems, and any element(s) that may cause any benefit, advantage, or solution to occur or become more pronounced are not to be construed as critical, required, or essential features or elements of any or all the claims of the invention. It should be understood that the detailed description and specific examples, indicating exemplary embodiments of the invention, are given for purposes of illustration only and not as limitations. Many changes and modifications within the scope of the instant invention may be made without departing from the spirit thereof, and the invention includes all such modifications. Corresponding structures, materials, acts, and equivalents of all elements in the claims below are intended to include any structure, material, or acts for performing the functions in combination with other claim elements as specifically claimed. The scope of the invention should be determined by the appended claims and their legal equivalents, rather than by the examples given above. Reference to an element in the singular is not intended to mean "one and only one" unless explicitly so stated, but rather "one or more." Moreover, where a phrase similar to "at least one of A, B, and C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

What is claimed is:

1. A shade system, comprising:

a roller tube having a roller axis;

a support cradle configured to support the roller tube; and, a floating plate configured with:

a vertical channel configured to allow the roller axis of the roller tube to move a limited range along only a first axis of movement with respect to the support cradle; and a first horizontal channel and a second horizontal channel disposed on opposing sides of the vertical channel, the first horizontal channel and the second horizontal channel each configured to allow the roller axis of the roller tube to move a limited range along only a second axis of movement with respect to the support cradle.

2. The system of claim 1, wherein the first horizontal channel and the second horizontal channel are separated by a stop block.

3. The system of claim 1, further comprising a second plate coupled to a first horizontal roller and a second horizontal roller, wherein the first horizontal roller is received into the first horizontal channel, and wherein the second horizontal roller is received into the second horizontal channel.

4. The system of claim 3, wherein the second plate is coupled to a motor.

5. The system of claim 3, further comprising an end cap having a vertical roller received into the vertical channel of the floating plate.

6. The system of claim 1, wherein the roller tube has a first end and a second end, and wherein the floating plate comprises a first floating plate interfacing with the first end and a second floating plate interfacing with the second end.

7. The system of claim 1, wherein the floating plate is configured to cause shade material wound about the roller tube to be deployed in a constant plane with respect to a shaded surface.

8. The system of claim 1, wherein the floating plate is configured to cause shade material wound about the roller tube to be deployed at a variable distance with respect to a shaded surface.

9. The system of claim 1, wherein the roller tube is actuated by a motor.

10. The system of claim 1, wherein the roller tube is actuated by at least one of a chain drive or a reel and tape drive.

11. The system of claim 1, wherein the support cradle comprises a bull nose at the feed side of the support cradle.

12. The system of claim 1, wherein the support cradle comprises a tube dam at the feed side of the support cradle.

13. The system of claim 1, wherein the first axis of movement is vertical, and wherein the second axis of movement is horizontal.

14. The system of claim 1, wherein the roller axis intersects the floating plate.

15. The system of claim 1, wherein the first channel is configured to allow the roller axis of the roller tube to move along the first axis of movement responsive to rotation of the roller tube.

16. A method, comprising:

moving, with respect to a support cradle in a roller shade system, the roller axis of a roller tube, wherein the moving is guided by a floating plate configured with:

a vertical channel configured to allow the roller axis of the roller tube to move a limited range along only a first axis of movement with respect to the support cradle; and a first horizontal channel and a second horizontal channel disposed on opposing sides of the vertical channel, the first horizontal channel and the second horizontal channel each configured to allow the roller axis of the roller tube to move a limited range along only a second axis of movement with respect to the support cradle.

17. The method of claim 16, wherein the moving is further guided by a second plate affixed to the roller tube and coupled to a roller received into the first horizontal channel of the floating plate.

18. The method of claim 16, further comprising at least one of rolling or unrolling a shade material, the shade material at least partially supported by the support cradle.

19. The method of claim 16, wherein the roller tube is actuated by at least one of a motor, a chain drive, or a reel and tape drive.

20. The method of claim 16, wherein the first channel is configured to allow the roller axis of the roller tube to move responsive to at least one of unrolling or rolling a shade material about the roller tube.

* * * * *